US010947071B2

(12) United States Patent
Lochbichler et al.

(10) Patent No.: US 10,947,071 B2
(45) Date of Patent: Mar. 16, 2021

(54) DEVICE FOR SEPARATING SHEET MATERIAL

(71) Applicant: Wincor Nixdorf International GmbH, Paderborn (DE)

(72) Inventors: Mathias Lochbichler, Paderborn (DE); Christopher Lankeit, Paderborn (DE); Martin Landwehr, Paderborn (DE); Ludger Hoischen, Borchen (DE)

(73) Assignee: Wincor Nixdorfinternational GmbH, Paderborn (DE)

( * ) Notice: Subject to any disclaimer, the term of this patent is extended or adjusted under 35 U.S.C. 154(b) by 0 days.

(21) Appl. No.: 15/320,881

(22) PCT Filed: Jun. 23, 2015

(86) PCT No.: PCT/EP2015/064081
§ 371 (c)(1),
(2) Date: Dec. 21, 2016

(87) PCT Pub. No.: WO2016/001011
PCT Pub. Date: Jan. 7, 2016

(65) Prior Publication Data

US 2017/0158444 A1 Jun. 8, 2017

(30) Foreign Application Priority Data

Jul. 1, 2014 (EP) ..... 14175196
Dec. 4, 2014 (EP) ..... 14196274

(51) Int. Cl.
*B65H 3/02* (2006.01)
*B65H 5/00* (2006.01)

(52) U.S. Cl.
CPC ..... *B65H 3/02* (2013.01); *B65H 5/008* (2013.01); *B65H 2301/42342* (2013.01);
(Continued)

(58) Field of Classification Search
CPC ... B65H 5/10; B65H 5/12; B65H 5/20; B65H 2301/42342; B65H 2301/441;
(Continued)

(56) References Cited

U.S. PATENT DOCUMENTS 3,276,770 A * 10/1966 Griswold ..... B65H 3/02 271/10.11
3,885,784 A 5/1975 Sautton
(Continued)

FOREIGN PATENT DOCUMENTS

DE 2201069 A1 8/1972
EP 0 060 389 9/1982
(Continued)

OTHER PUBLICATIONS

English Translation of International Preliminary Report on Patentability FOT Application No. PCT/EP2015/064081 dated Jan. 3, 2017.
(Continued)

*Primary Examiner* — Howard J Sanders
(74) *Attorney, Agent, or Firm* — Black, McCuskey, Souers & Arbaugh LPA

(57) ABSTRACT

A device for separating sheet material has an actuator and a sheet material holder coupled thereto. The actuator is designed for moving the sheet material holder. The sheet material holder is designed for receiving an individual sheet material piece from a sheet material stack in which the sheet material pieces are arranged in a layered manner one above another along a vertical direction. The actuator is designed to set the sheet material holder into an oscillating rotational movement about a rotation axis that lies substantially parallel to the vertical direction, in order to receive the individual sheet material piece from the sheet material stack.

18 Claims, 6 Drawing Sheets

(52) U.S. Cl.
CPC .. *B65H 2301/441* (2013.01); *B65H 2401/111* (2013.01); *B65H 2404/532* (2013.01); *B65H 2404/66* (2013.01); *B65H 2515/50* (2013.01); *B65H 2701/1912* (2013.01)

(58) Field of Classification Search
CPC ..... B65H 2515/50; B65H 3/02; B65H 5/008; B65H 2404/66
See application file for complete search history.

(56) References Cited

U.S. PATENT DOCUMENTS

| | | | | |
|---|---|---|---|---|
| 3,929,328 | A | 12/1975 | Knappe et al. | |
| 4,398,709 | A * | 8/1983 | Janssen | B65H 3/0646 271/10.12 |
| 4,955,598 | A | 9/1990 | Hiroshige et al. | |
| 5,967,292 | A * | 10/1999 | Corrales | B65G 47/086 198/379 |
| 7,694,957 | B2 * | 4/2010 | Nukada | B65H 3/60 271/146 |
| 2004/0129771 | A1 | 7/2004 | Landwehr | |
| 2007/0273080 | A1 * | 11/2007 | Toya | B65H 1/24 271/109 |
| 2008/0223520 | A1 * | 9/2008 | Toya | B65H 3/06 156/705 |
| 2009/0218752 | A1 * | 9/2009 | Kobayashi | B65H 1/24 271/10.09 |
| 2012/0073937 | A1 * | 3/2012 | Toya | B65G 59/02 198/617 |
| 2015/0203306 | A1 | 7/2015 | Muller | |

FOREIGN PATENT DOCUMENTS

| | | | |
|---|---|---|---|
| EP | 0750278 | A1 | 12/1996 |
| GB | 2 125 375 | | 3/1984 |
| WO | 02063572 | A2 | 8/2002 |
| WO | 2014/005715 | | 1/2014 |

OTHER PUBLICATIONS

International Search Report dated Oct. 8, 2015.

* cited by examiner

DEVICE FOR SEPARATING SHEET MATERIAL

CROSS-REFERENCE TO A RELATED APPLICATION

This application is a National Phase Patent Application of International Patent Application Number PCT/EP2015/064081, filed on Jun. 23, 2015, which claims priority of each of the European Patent Application EP114175196.6, filed on Jul. 1, 2014, and of the European Patent Application EP14196274.6, filed on Dec. 4, 2014.

BACKGROUND

The present invention relates to a device for singularizing sheet material.

A device of the generic type for singularizing sheet material has an actuator and a sheet-material receiver coupled thereto. The actuator is configured for repositioning the sheet-material receiver, for example in such a manner that the sheet-material receiver is set in a translatory motion or in a rotary motion. For example, a previously known sheet-material receiver is designed in the manner of a roller. The sheet-material receiver herein is configured for receiving an individual sheet-material piece from a sheet-material stack, wherein in which sheet-material stack has a multiplicity of sheet-material pieces that is disposed in a layered manner on top of one another along a plumb-line direction.

The sheet material may be paper sheets, cardboard sheets, for example, or paper securities, for example bank notes, currency notes, checks, or the like. A respective sheet-material stack thus comprises a stack of paper securities, paper sheets, or cardboard sheets, for example.

A device of the generic type for singularizing sheet material is described in WO 2014/005715 A1, for example. The sheet-material receiver therein is configured in the shape of an oscillating conveyor belt by way of which individual sheet-material pieces may be retrieved from a sheet-material stack. However, the conveyor belt does not engage the topmost sheet-material piece of the sheet-material stack, but the lowermost sheet-material piece of the sheet-material stack. The sheet-material pieces are thus drawn from the lower side of the sheet-material stack by the oscillating conveyor belt.

It is an object of the present invention to provide a means that permits secure and reliable singularization of sheet material.

This technical object is achieved by the subject matter described herein.

SUMMARY

According to the invention, it is provided that the actuator is configured for setting the sheet-material receiver in an oscillating rotary motion about a rotation axis that lies substantially parallel with the plumb-line direction, so as to receive the individual sheet-material piece from the sheet-material stack. The individual sheet-material piece is preferably the topmost or lowermost sheet-material piece of the sheet-material stack.

The sheet material is, for example, paper sheets, cardboard sheets, paper securities such as bank notes, currency notes, checks or similar. The sheet-material stack preferably has a multiplicity of sheet-material pieces of the same type. This facilitates controlling of the actuator. The sheet-material pieces of the sheet-material stack are configured, for example, so as to be of a rectangular box shape, each having one length, one width, and one height, wherein the height of the respective sheet-material piece is a fraction of the length and of the width, as is the case with currency notes, for example.

The actuator comprises, for example, electromechanical means which are actuatable in order for the sheet-material receiver to be set in said oscillating rotary motion about the rotation axis. The exact design embodiment of the actuator will be discussed in more detail at a later point.

The oscillating rotary motion about the rotation axis extends along an angular range of less than 10°, for example. The angular range is approximately 1°, for example. Accordingly, the actuator is configured, for example, for rotating the sheet-material receiver about the rotation axis by approximately 1°, and subsequently for causing a rotary motion in the opposite direction.

The frequency of the oscillating rotary motion is preferably greater than 1 kHz. For example, the frequency of the oscillating rotary motion is approximately 40 kHz. The frequency of the oscillating rotary motion is preferably determined so as to depend on the height of the individual sheet-material piece. For example, the frequency is proportional to a reciprocal value of the height.

In the case of a further embodiment of the device, the actuator is configured for setting the sheet-material receiver in a translatory motion along the plumb-line direction, so as to press the sheet-material receiver for receiving the individual sheet-material piece onto a surface of the individual sheet-material piece at a specific force. For example, the actuator positions the sheet-material receiver above the sheet-material stack, so as to thereupon press the sheet-material receiver onto a central point, for example onto a centerpoint, of the topmost sheet-material piece.

The sheet-material receiver, by virtue of the oscillating rotary motion thereof about the rotation axis and by virtue of a force exerted by the actuator for pressing the sheet-material receiver onto the surface of the individual sheet-material piece, is preferably configured for initiating an attractive force between the sheet-material receiver and the individual sheet-material piece, so as to remove the individual sheet-material piece from the sheet-material stack. For example, contact, for example a so-called surface-to-flexible-surface contact, is initiated between the sheet-material piece and the individual sheet-material piece to be received and to be removed, said contact initiating the generating of the attractive force. By way of the initiated attractive force it is possible for the individual sheet-material piece to be removed from the sheet-material stack. For this purpose, the actuator is preferably configured for setting the sheet-material receiver in a translatory motion along a first direction that lies substantially perpendicular to the plumb-line direction, so as to remove the received individual sheet-material piece from the sheet-material stack, wherein the first direction preferably lies substantially perpendicular to a longitudinal side of the individual sheet-material piece. Alternatively or additionally thereto, it is preferable for the actuator to be configured for setting the sheet-material receiver in a translatory motion along a second direction that lies substantially perpendicular to the plumb-line direction, so as to remove the received sheet-material piece from the sheet-material stack, wherein the second direction preferably lies substantially parallel with the longitudinal side of the individual sheet-material piece.

For example, the actuator is configured for initially positioning the sheet-material receiver above the sheet-material stack, so as to thereupon press the sheet-material receiver onto the surface of the topmost sheet-material piece. Prior, during, or thereafter, the actuator sets the sheet-material receiver in said oscillating rotary motion. On account thereof, the attractive force is initiated between the distal end of the sheet-material receiver that lies on the surface of the sheet-material piece, and the surface of the individual sheet-material piece. The topmost sheet-material piece of the sheet-material stack thus adheres to the distal end of the sheet-material receiver. While maintaining the oscillating rotary motion, a translatory motion along said first direction and/or along the second direction and/or along the plumb-line direction is performed, such that only the topmost sheet-material piece of the sheet-material stack is removed from the sheet-material stack and is fed to a sheet-material collection container or to a sheet-material input device and/or to a sheet-material output device, for example.

The sheet-material receiver, at the distal end thereof that during positioning of the sheet-material receiver above the sheet-material stack points to the surface of the topmost sheet-material piece, preferably has a receiving head. Furthermore, a coupling element for coupling to the actuator is preferably provided at the proximal end of the sheet-material receiver. The coupling element is preferably designed in such a manner that the actuator is configured for setting the sheet-material receiver in said oscillating rotary motion.

For example, the sheet-material receiver, in terms of the mass distribution thereof and/or in terms of the dimensions thereof, in relation to the rotation axis is configured so as to be rotationally symmetrical, for example so as to be substantially cylindrical. No or at most a minor imbalance force is created by virtue of the rotationally symmetrical configuration of the sheet-material receiver during the oscillating rotary motion.

The receiving head that is provided at the distal end of the sheet-material receiver may have a convex, a planar, or a concave circumferential profile. For example, the sheet-material receiver at the distal end thereof is designed so as to be rounded, that is to say convex or concave, for example in such a manner that the receiving head is configured so as to be approximately spherical-symmetrical in relation to a reference point that lies on the rotation axis. The contact face between the surface of the topmost sheet-material piece of the sheet-material stack and the sheet-material receiver, by virtue of the approximately spherical-symmetrical configuration of a convex receiving head of the sheet-material receiver, is comparatively minor.

In the case of a further preferred embodiment, the sheet-material receiver for contacting the individual sheet-material piece has an elastic material. The elastic material is silicone, for example, or another rubber-type material, for example an elastomer. The elastic material has a hardness of approximately 30 to 95 Shore A, for example, approximately 40 Shore A, for example.

In the case of an exemplary embodiment, the sheet-material receiver has a main body from a first material, and a coating applied thereto from a second material, wherein the second material contains the elastic material. The coating is provided on the receiving head, for example, and is designed as a surface coating, for example. For example, the main body is designed so as to be substantially cylindrical, having a length of approximately 10 mm and a radius of approximately 5 mm, wherein the thickness of the coating is approximately 0.5 mm, for example.

The sheet-material receiver is preferably coupled to the actuator by way of a fixed bearing. The actuator has a rotary element and a translatory element, for example. The translatory element is configured for setting the sheet-material receiver in said oscillating rotary motion. Repositioning of the sheet-material receiver along the plumb-line direction is preferably performed by way of the translatory element of the actuator. The coupling element of the sheet-material receiver is preferably coupled to the rotary element of the actuator. The translatory element and the rotary element of the actuator are preferably intercoupled by way of a rotary joint.

The device has a control unit for controlling the actuator, for example. The control unit is configured, for example, for providing control signals according to a control program and for feeding said control signals to the actuator, said actuator transforming said control signals into mechanical movements and thus setting the sheet-material receiver in said oscillating rotary motion and/or translatory motion.

Furthermore, the device may have a movably mounted coupling piece which couples the actuator to a base that is installed in a locationally fixed manner. For example, the coupling piece is mounted so as to be movable in said first and/or second direction, the latter two being perpendicular to the plumb-line direction, and is likewise actuated by the control unit. In the case of this example, the positioning of the sheet-material receiver may be performed above the topmost sheet-material piece of the sheet-material stack, by means of the coupling piece, wherein the actuator and the sheet-material receiver herein are not moved in relation to the coupling piece. The actuator and the sheet-material receiver are only moved in relation to the coupling piece for pressing the sheet-material receiver onto the surface of the topmost sheet-material piece, and for setting the sheet-material receiver in said oscillating rotary motion.

The method according to independent patent claim 16 forms a further aspect of the present invention. The method according to the invention for singularizing sheet material shares the advantages of the device according to the invention for singularizing sheet material, and has preferred embodiments which correspond to the above-described preferred embodiments of the device of the first aspect of the present invention, in particular as said preferred embodiments are defined in the dependent claims. To this extent reference is made to what has been discussed hereabove.

It is particularly preferable for the method to comprise positioning of the sheet-material receiver above the sheet-material stack, and pressing of the sheet-material receiver onto the surface of the topmost sheet-material piece of the sheet-material stack, and setting of the sheet-material receiver in the oscillating rotary motion about the rotation axis that lies substantially parallel with the plumb-line direction, so as to receive and remove the individual sheet-material piece from the sheet-material stack. In this case, the sheet-material receiver is set in the oscillating rotary motion before pressing, during pressing or after pressing the sheet-material receiver onto the topmost sheet-material piece.

The subject matter of the present invention is suitable for singularizing sheet material of any type. In particular, the subject matter of the present invention may be employed for singularizing paper securities, such as currency notes or bank notes.

One advantage of the present invention lies in particular in that the singularization of sheet material may be performed in a secure and reliable manner, using few components. In particular, the singularization of sheet material may be performed without a friction partner having to be provided in the case of the device, which friction partner prevents those sheet-material pieces that lie below the topmost sheet-material piece from being conjointly removed when the topmost sheet-material piece is being received by the sheet-material receiver.

In the case of the above explanation of the device and of the method for singularizing sheet material, it has always been assumed that the sheet-material receiver engages the topmost sheet-material piece of the sheet-material stack. However, it is also possible for the sheet-material receiver to engage the lowermost sheet-material piece of the sheet-material stack. In the case of this variant, the sheet-material receiver is pressed onto the lower side of the lowermost sheet-material piece and is likewise set in said oscillating rotary motion. This variant thus has preferred embodiments that correspond to the above-described preferred embodiments of the present invention, in particular as said embodiments are defined in the dependent claims. To this extent, reference is made to what has been discussed hereabove.

The concept underlying the invention is to be explained in more detail hereunder by means of the exemplary embodiments that are illustrated in the figures.

DETAILED DESCRIPTION

Figure 2:
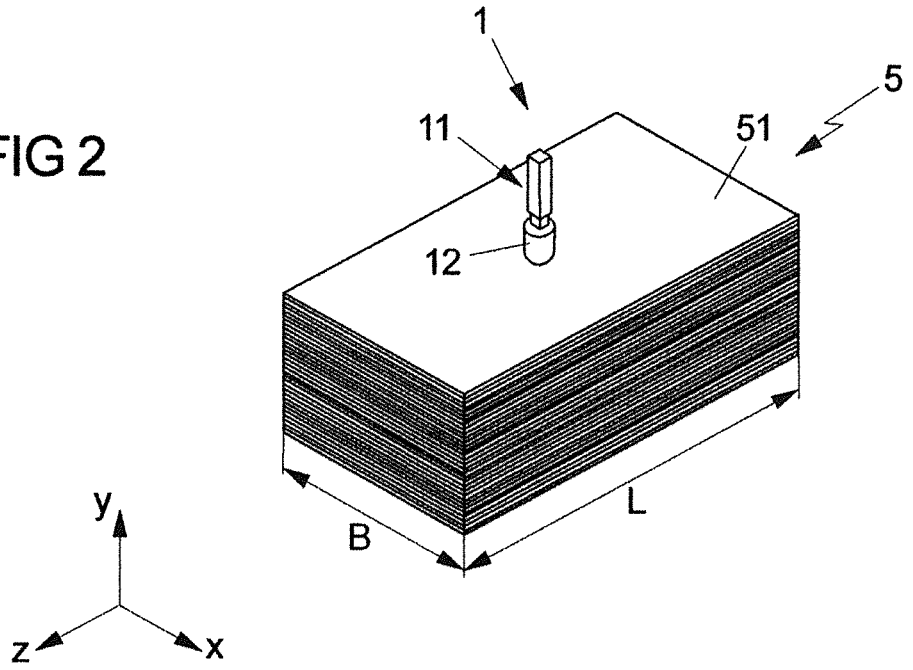
FIG. 2 shows a perspective and schematic view of a device for singularizing sheet material.
Figure 3:
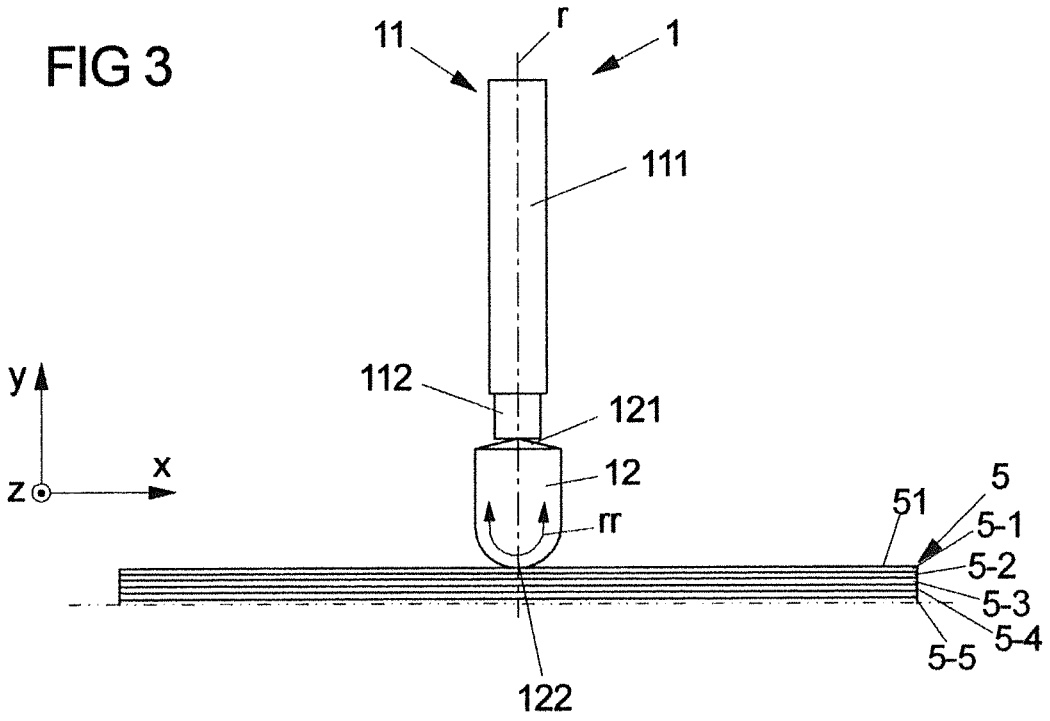
FIG. 3 shows a schematic cross-sectional view of the device shown in FIG. 2.
Figure 4:
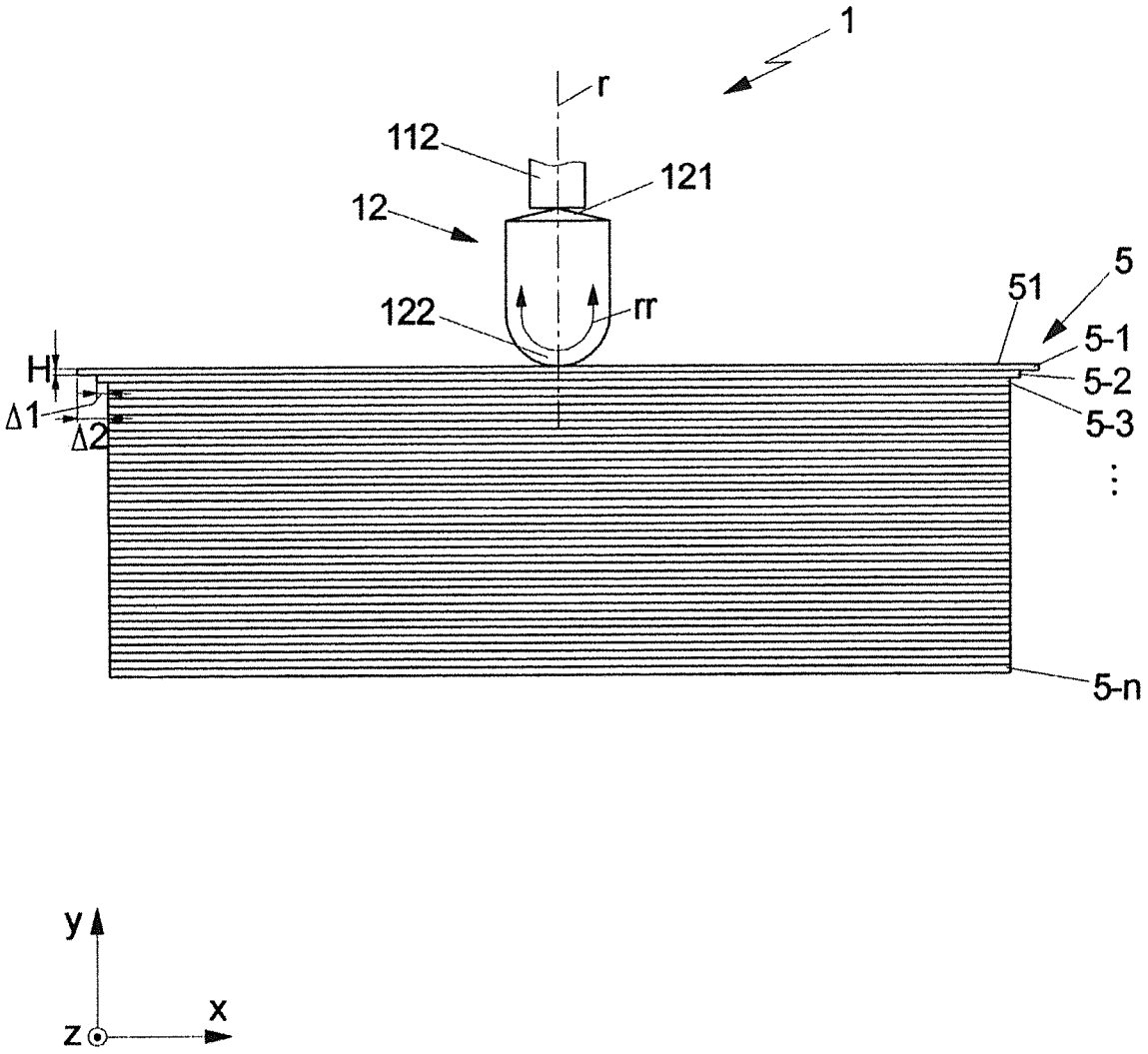
FIG. 4 shows a further schematic cross-sectional view of the device shown in FIG. 2.

FIG. 2 to FIG. 4 show schematic views of a device 1 for singularizing sheet material. FIG. 2 shows the device 1 in a perspective view, and FIG. 3 and FIG. 4 show the device in cross-sectional views.

The device 1 is designed for singularizing sheet material. Specifically, it is intended that individual sheet-material pieces 5-1 to **5-*n* that are disposed in a layered manner on top of one another along a plumb-line direction y and thus configure a sheet-material stack 5 are singularized. To this end, the device 1 comprises a sheet-material receiver 12 which is driven by an actuator 11 of the device 1. The actuator 11 thus sets the sheet-material receiver 12 in specific motions, as will be explained in more detail at a later point. A schematic cross-sectional view of this sheet-material receiver 12 is shown in FIG. 5**.

In order for the configuration of the device 1 for singularizing sheet material, and for a method for singularizing sheet material, to be explained, reference is made hereunder to all FIGS. 2 to 5. It is to be subsequently explained in an exemplary manner by means of FIG. 1 how specific control parameters for operating the device 1 may be calculated.

The actuator 11 has a translatory element 111 and a rotary element 112. The actuator 11 is actuated by a control unit (not shown in the figures) of the device 1.

The translatory element 111 is configured for repositioning the sheet-material receiver 12 along the plumb-line direction y, and the sheet-material receiver is set in an oscillating rotary motion about a rotation axis r that lies parallel with the plumb-line direction y by way of the rotary element 112 of the actuator 11.

Moreover, the actuator 11, having the translatory element 111 and the rotary element 112, is disposed so as to be movable along a first direction x that lies substantially perpendicular to the plumb-line direction y, and/or a second direction z, such that a received sheet-material piece 5-1 may be removed from the sheet-material stack 5 in the x-direction or the z-direction.

The sheet-material stack 5 is, for example, a stack of paper sheets, cardboard sheets, paper securities (for example bank notes, currency notes, or checks), or similar sheet-shaped media. Said media is disposed in a layered manner on top of one another along the plumb-line direction y, thus configuring the sheet-material stack 5. Each of the sheet-material pieces 5-1 to **5-*n* in the example shown has the same length L, the same width B, and the same height H. However, the subject matter of the present invention does not require that all sheet-material pieces 5-1 to 5-*n*** have the same dimensions.

In order for an individual sheet-material piece, specifically the topmost sheet-material piece 5-1, to be received, the actuator 11, having the sheet-material receiver 12 coupled thereto, is initially positioned above the sheet-material stack 5. Thereafter, the actuator 11 presses the sheet-material receiver 12 onto a surface 51 of the topmost sheet-material piece 5-1, for example onto a central point of the topmost sheet-material piece 5-1, as is schematically shown in FIG. 2. Thereafter, the actuator 11 by means of the translatory element 111 presses the sheet-material receiver 12 onto the surface 51 of the topmost sheet-material piece 5-1 at a specific force. Prior, during, or after pressing the sheet-material receiver 12 onto the surface 51, the actuator 11 by means of the rotary element 112 sets the sheet-material receiver 12 in an oscillating rotary motion about the rotation axis r.

The oscillating rotary motion about the rotation axis r extends across an angular range of less than 10°. For example, the actuator 11 rotates the sheet-material receiver 12 by an angle ∥ of 1° about the rotation axis r along a rotation direction rr. Thereafter, the actuator 11 sets the sheet-material receiver 12 in a rotation by 1° along the opposite rotation direction rr, repeating this procedure at a specific frequency. This oscillating rotary motion is performed at a frequency of greater than 1 kHz, for example. The frequency is approximately 20 to 40 kHz, for example. The frequency is determined so as to depend on the height H of the individual sheet-material piece 5-1, for example. For example, the frequency is proportional to a reciprocal value of the height H of the individual sheet-material piece 5-1. This will be explained in more detail at a later point with reference to FIG. 1.

Figure 5A:
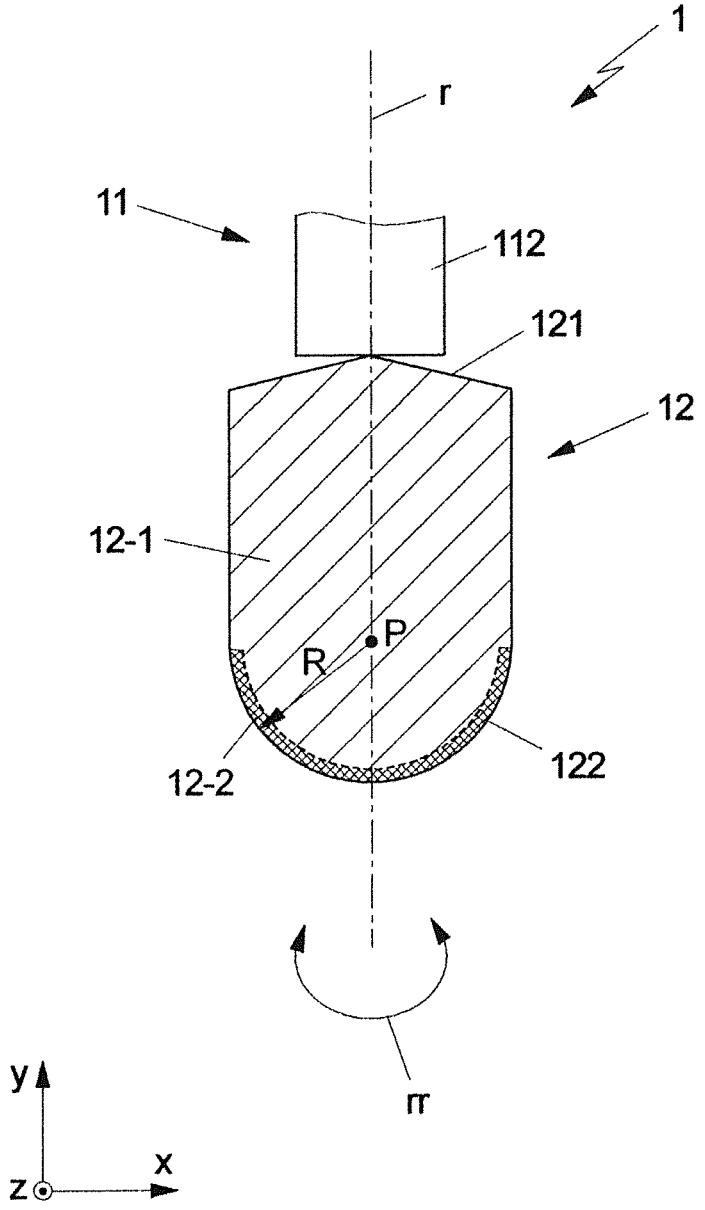
FIGS. 5A-C show schematic cross-sectional views of a sheet-material receiver in the device shown in FIG. 2.
Figure 5B:
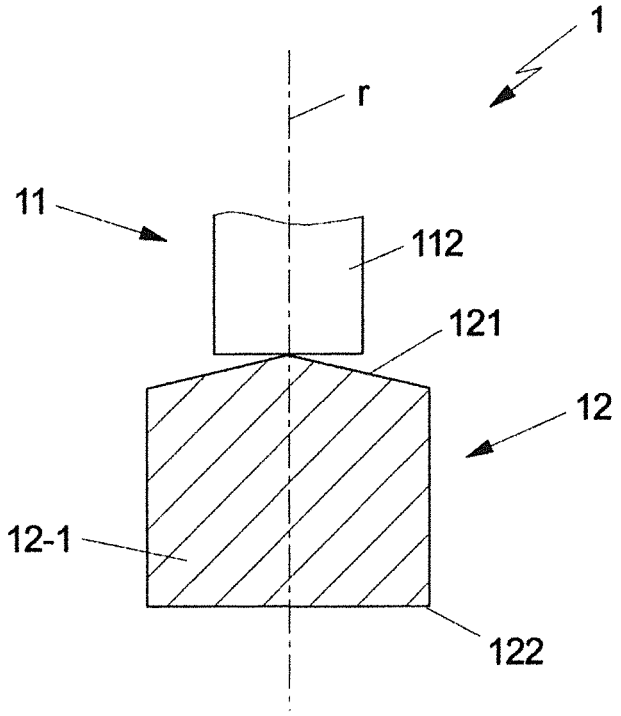
Figure 5C:
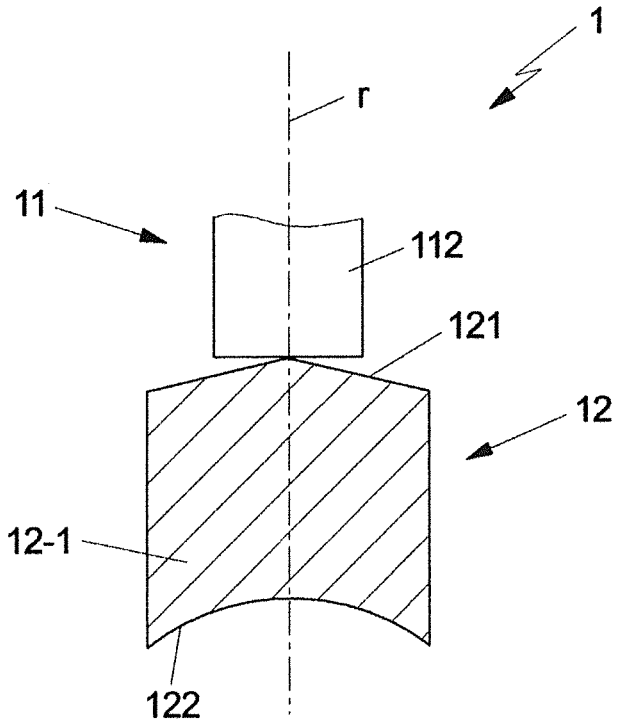

With reference to FIGS. 5A-C, exemplary potential design embodiments of the sheet-material receiver 12 are to be discussed in more detail initially. The sheet-material receiver 12 at the proximal end thereof comprises a coupling element 121 which in FIG. 5 is illustrated in only a schematic manner. The sheet-material receiver 12 by way of the coupling element 121 is coupled to the rotary element 112 of the actuator 11.

The sheet-material receiver 12 is designed so as to be substantially cylindrical, in particular thus so as to be rotationally symmetrical in relation to the rotation axis r. The sheet-material receiver 12 at the distal end thereof has a receiving head 122.

In the case of the example shown in FIG. 5A, the receiving head 122 is designed so as to be spherical-symmetrical and convex in relation to a reference point P that lies on the rotation axis r. In other words, the receiving head 122, and thus the distal end of the sheet-material receiver 12, has a convex circumferential profile. The surface of the receiving head 122 may thus be designed in such a manner that each point lying thereon has the same distance R, which consequently corresponds to a spherical radius, with respect to the reference point P. This spherical radius R is established so as to depend on the application or on the type of sheet material, respectively.

In the case of the example corresponding to FIG. 5A, the sheet-material receiver 12 has a main body 12-1 that is molded from a first material, and a coating 12-2 from a second material that differs from the first material. The second material of the coating 12-2 comprises an elastic material, for example silicone or another rubber-type material. The first material of the main body 12-1 of the sheet-material receiver 12 has an elasticity that is lower than the elasticity of the material of the coating 12-2. The coating 12-2 in the case of the example shown is provided only on the receiving head 122, and has a minor thickness of one millimeter or less than one millimeter, for example 0.5 mm.

However, the sheet-material receiver 12 at the distal end thereof does not necessarily have to have a convex circumferential profile and/or said coating 12-2. In the case of the variant according to FIG. 5B, the receiving head 122, and thus the distal end of the sheet-material receiver 12, has a substantially planar circumferential profile, and, in the variant according to FIG. 5C, the receiving head 122, and thus the distal end of the sheet-material receiver 12, has a substantially convex circumferential profile.

Depending on the type of the sheet-material piece 5-1, . . . , **5-*n* to be received, one specific circumferential profile of the receiving head 122 may be more expedient than another. Notwithstanding the sheet-material receiver 12 in FIG. 3 and FIG. 4 being shown having a receiving head 122 having a convex circumferential profile, the exemplary embodiments therein are not limited to such a receiving head 122. Rather, the receiving head 122 also in the case of the examples according to FIG. 3 and FIG. 4** may have a substantially planar or a concave circumferential profile.

Once the actuator 11 has pressed the sheet-material receiver 12 onto the surface 51 of the topmost sheet-material piece 5-1, and has set the sheet-material receiver 12 in said oscillating rotary motion, the topmost sheet-material piece 5-1 is repositioned by a first distance Δ1 in the x-direction, and a sheet-material piece 5-2 lying therebelow is repositioned by a second distance Δ2. It can be clearly seen in FIG. 4 that the first distance Δ1 is significantly greater than the second distance Δ2.

Ultimately, the contact pressure of the sheet-material receiver 12 and the oscillating rotary motion of the sheet-material receiver 12 enable the removal of the topmost sheet-material piece 5-1 from the sheet-material stack 5. The actuator 11, while maintaining the oscillating rotary motion of the sheet-material receiver 12, may draw the topmost sheet-material piece 5-1 from the sheet-material stack 5, and convey said topmost sheet-material piece 5-1 to a sheet-material output device (not shown in the figures), for example. Upon delivery of the conveyed sheet-material piece 5-1, the actuator 11 returns to the sheet-material stack 5 and proceeds in the same way with the next sheet-material piece 5-2.

The sheet-material receiver 12, by virtue of the oscillating rotary motion thereof about the rotation axis r, and by virtue of the force exerted by the actuator 11 for pressing the sheet-material receiver 12 onto the surface 51 of the topmost sheet-material piece 5-1, is thus configured for initiating an attractive force between the sheet-material receiver 12 and the individual sheet-material piece 5-1, such that the individual sheet-material piece 5-1 may be removed from the sheet-material stack 5.

Figure 1:
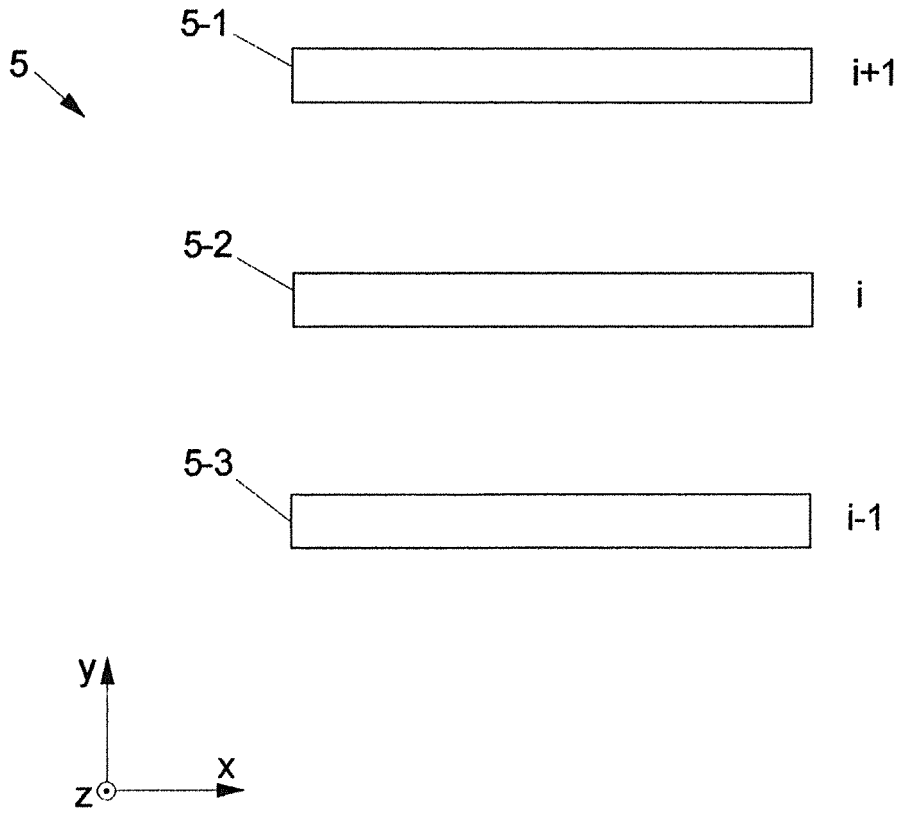
FIG. 1 shows a schematic cross-sectional view of three sheet-material pieces.

In order for the frequency of the oscillating rotary motion of the sheet-material receiver 12 to be determined, the following procedure may be followed, for example: The sheet-material stack 5 is modeled as a monolithic bar having a rectangular cross section. This bar comprises n imaginary elements, wherein n corresponds to the number of individual sheet-material pieces 5-1 to **5-*n*, each element corresponding to one sheet-material piece. Of these n elements, the elements i−1, i, and i+1, which thus in an exemplary manner represent three sheet-material pieces 5-1, 5-2, and 5-3, lying on top of one another, are illustrated in FIG. 1**.

By means of the equation 1

$$M\cdot\ddot{\varphi}+K\cdot\varphi=0 \text{ with } M,\ K\in\mathbb{R}^{n*n} \tag{1}$$

eigenmodes of this bar are determined. In the equation (1)

M refers to a mass matrix,

K refers to a rigidity matrix,

φ refers to a twisting angle of an element (sheet-material piece about the rotation axis r), and $\ddot{\varphi}$ refers to the second temporal derivation of φ.

Equations of motion are established in order for the mass matrix M and the rigidity matrix K to be determined. A respective connection between the individual n imaginary elements is modulated as a torsion spring having a rigidity c. This rigidity c results from the following equations 2 for a twisting angle of an element subjected to torsion:

$$\varphi=T\cdot\frac{d}{G\cdot I_t}\rightarrow T=\frac{G\cdot I_t}{d}\cdot\varphi\rightarrow c=\frac{G\cdot I_t}{d} \tag{2}$$

In the equation (2)

T refers to the torque of torsion

G refers to the shear modulus $I_t$ refers to the area moment of inertia d refers to the length of the bar The equation of motion 3 results for the $i^{th}$ element (sheet-material piece):

$$J_i\cdot\ddot{\varphi}_i+c\cdot(\varphi_i-\varphi_{i+1})+c\cdot(\varphi_i-\varphi_{i-1})=0 \text{ with } 1\leq i<n \tag{3}$$

wherein J refers to a rotary inertia, and the following equation 4 results for the $n^{th}$ equation of motion:

$$J_i\cdot\ddot{\varphi}_i+c\cdot(\varphi_i-\varphi_{i-1})=0 \tag{4}$$

In the case of a sheet-material stack having three sheet-material pieces (n=3), the mass matrix M and the rigidity matrix K result as follows:

$$M=\begin{bmatrix} J & 0 & 0 \\ 0 & J & 0 \\ 0 & 0 & J \end{bmatrix} \text{ and } K=\begin{bmatrix} 2\cdot c & -c & 0 \\ -c & 2\cdot c & -c \\ 0 & -c & c \end{bmatrix}$$

By means of the complete description of the bar by way of the two matrices M and K, the natural frequencies together with the respective eigenmodes that are described by the eigenvectors may be determined. For example, a calculation is performed using the following parameters which are reflected in the table:

| Formula indicator | Variable | Value | Unit |
|---|---|---|---|
| $\phi_i$ | Twisting angle of the $i^{th}$ element (sheet-material piece) | | |
| n | Number of elements lying on top of one another (sheet-material pieces) | 60 | |
| m | Mass of an individual element (sheet-material piece) | 0.001125 | kg |
| G | Shear modulus | 300000 | $\frac{N}{m^2}$ |
| B | Width of an individual element (sheet-material piece) | 0.075 | m |
| L | Length of an individual element (sheet-material piece) | 0.15 | m |
| $I_t$ | Area moment of inertia to torsion | 0.0000144842 | $m^4$ |
| k | Computation coefficient | 0.22888542 | |
| H | Height of an individual element (sheet-material piece) | 0.001 | m |
| J | Rotary inertia | 0.00000263672 | kg $m^2$ |
| C | Rigidity torsion spring | 4345.26 | Nm |

By means of this data, for example by means of the equation (2) and the values in the table, it may be determined that the frequency of the oscillating rotary motion is to be 40.595 kHz, for example, in order for the topmost sheet-material piece 5-1 to be removed from the sheet-material stack 5, without the remaining sheet-material pieces 5-2 to **5-*n* being removed conjointly from the sheet-material stack 5. In particular, it is also possible for the frequency of the oscillating rotary motion to be determined independently of the number n of the sheet-material pieces 5-1 to 5-*n***. Numerical values and computation methods stated above are to be understood as being merely exemplary, of course.

In the case of the above explanation of the device and of the method for singularizing sheet material, it has always been assumed that the sheet-material receiver 12 engages the topmost sheet-material piece 5-1 of the sheet-material stack 5. However, it is also possible for the sheet-material receiver 12 to engage the lowermost sheet-material piece **5-*n* of the sheet-material stack 5. In the case of this variant, the sheet-material receiver 12 is pressed onto the lower side of the lowermost sheet-material piece 5-*n*** and is likewise set in said oscillating rotary motion about the rotation axis r.

LIST OF REFERENCE SIGNS/ABBREVIATIONS USED

1 Device for singularizing sheet material
11 Actuator
12 Sheet-material receiver
12-1 Main body
12-2 Coating
121 Coupling element
122 Receiving head
5 Sheet-material stack
5-1, . . . , **5-*n*** Sheet-material pieces
51 Surface of the topmost sheet-material piece 5-1
B Width of an individual sheet-material piece
L Length of an individual sheet-material piece
H Height of an individual sheet-material piece
r Rotation axis
rr Direction of the oscillating rotary motion (Rotation direction)
R Spherical radius
P Reference point on the rotation axis r
x x-axis/first direction
y y-axis/plumb-line direction
z z-axis/second direction
Δ1 First distance
Δ2 Second distance

What is claimed is:

1. A device for separating sheet material, having an actuator and a sheet-material engagement coupled thereto and an engaging head at a distal end of the sheet-material engagement, the engaging head has an elastic material having a hardness of 30 to 95 Shore A for contacting the sheet-material, wherein the actuator is configured for repositioning the sheet-material engagement, and wherein the sheet-material engagement is configured for engaging an individual sheet-material piece from a sheet-material stack in which a multiplicity of sheet-material pieces are disposed in a layered manner on top of one another along a plumb-line direction, wherein the actuator is configured for setting the sheet-material engagement in an oscillating rotary motion about a rotation axis extending along an angular range of less than 10, where the sheet-material engagement rotates about the rotation axis in a first direction and in a direction opposite the first direction about the rotation axis, and repeats rotating in the first direction and the direction opposite the first direction at a specific frequency greater than 1 kHz while engaged with the individual sheet-material piece from the sheet-material stack; and the rotation axis lies substantially parallel with the plumb-line direction, so as to engage the individual sheet-material piece from the sheet-material stack.

2. The device as claimed in claim 1, wherein the sheet-material engagement in relation to the rotation axis is configured to be rotationally symmetrical.

3. The device as claimed in claim 1, wherein the engaging head has a convex, a planar, or a concave circumferential profile.

4. The device as claimed in claim 1, wherein the actuator is configured to remove the engaged individual sheet-material piece from the sheet-material stack in a first direction substantially perpendicular to a longitudinal side of the individual sheet-material piece.

5. The device as claimed in claim 1, wherein the actuator is configured to remove the engaged individual sheet-material piece from the sheet-material stack in a second direction substantially perpendicular to the plumb-line direction.

6. The device as claimed in claim 1, wherein the actuator is configured to press the sheet-material engagement for engaging the individual sheet-material piece onto a surface of the individual sheet-material piece at a specific force.

7. The device as claimed in claim 1, wherein the frequency of the oscillating rotary motion is determined so as to depend on a height of the individual sheet-material piece.

8. The device as claimed in claim 1, wherein the sheet-material engagement engaging head has a main body from a first material, and a coating applied thereto from a second material, wherein the second material contains the elastic material.

9. The device as claimed in claim 8, wherein the main body is substantially cylindrical, having a length of approximately 10 mm and a radius of approximately 5 mm, wherein the thickness of the coating is approximately 0.5 mm.

10. The device as claimed in claim 1, wherein the sheet-material engagement, by virtue of the oscillating rotary motion thereof about the rotation axis and by virtue of a force exerted by the actuator for pressing the sheet-material engagement onto a surface of the individual sheet-material piece, is configured for initiating an attractive force between the sheet-material engagement and the individual sheet-material piece so as to remove the individual sheet-material piece from the sheet-material stack.

11. The device as claimed in claim 1, wherein the actuator is configured for repositioning the sheet-material engagement along the plumb-line direction, and is configured for setting the sheet-material engagement in said oscillating rotary motion about the rotation axis.

12. The device as claimed in claim 1, further comprising a coupling element at a proximal end of the sheet-material engagement for coupling to the actuator.

13. The device as claims in claim 1, wherein the frequency is 20 to 40 kHz.

14. A method for separating sheet material by means of a device having an actuator and a sheet-material engagement coupled thereto, wherein the actuator is configured for repositioning the sheet-material engagement, and wherein the sheet-material engagement is configured for engaging an individual sheet-material piece from a sheet-material stack in which a multiplicity of sheet-material pieces are disposed in a layered manner on top of one another along a plumb-line direction, wherein the method comprises the following steps:

setting the sheet-material engagement in an oscillating rotary motion about a rotation axis, where the sheet-material engagement repeatedly rotates in an oscillating rotary motion while engaged with the individual sheet-material piece from the sheet-material stack at a specified frequency about the rotation axis in both a first direction and a direction opposite the first direction about the rotation axis, by means of the actuator, to engage the individual sheet-material piece from the sheet-material stack while conveying the individual sheet-material piece from the sheet-material stack along a direction perpendicular to the plumb-line direction, wherein the rotation axis lies substantially parallel with the plumb-line direction wherein the specified frequency is determined by modeling the sheet-material stack as a monolithic bar having elements corresponding to the multiplicity of sheet-material pieces.

15. The method as claimed in claim 14, where the modeling includes eigenmodes determined from a first equation including a mass matrix and a rigidity matrix.

16. The method as claimed in claim 15, where a connection between the individual sheet material pieces is modulated as a torsion spring.

17. The method as claimed in claim 16, where the modeling further includes a second equation describing the relation between torque of torsion, sheer modulus, and area moment of inertia.

18. The method as claimed in claim 17, where the modeling further includes a third equation defining motion for the individual sheet-material piece.

* * * * *